US008166721B1

(12) United States Patent
diGirolamo et al.

(10) Patent No.: US 8,166,721 B1
(45) Date of Patent: May 1, 2012

(54) METAL-WOOD STRUCTURAL MEMBER

(75) Inventors: Edward R. diGirolamo, Raleigh, NC (US); Milan Dragic, Wake Forest, NC (US); Michael L. Torres, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 1463 days.

(21) Appl. No.: 11/358,758

(22) Filed: Feb. 21, 2006

(51) Int. Cl.
*E06B 3/70* (2006.01)

(52) U.S. Cl. ..... 52/455; 52/456; 52/458

(58) Field of Classification Search ..... 52/729.1, 52/729.4, 729.5, 455, 456, 458
See application file for complete search history.

(56) References Cited

U.S. PATENT DOCUMENTS

| | | | | |
|---|---|---|---|---|
| 2,129,625 | A * | 9/1938 | Rafter | 52/376 |
| 2,252,956 | A * | 8/1941 | Adler | 52/376 |
| 4,070,845 | A * | 1/1978 | Cody | 52/632 |
| 4,159,604 | A * | 7/1979 | Burrell | 52/376 |
| 4,893,961 | A * | 1/1990 | O'Sullivan et al. | 403/232.1 |
| 6,332,299 | B1 * | 12/2001 | Stewart, III | 52/696 |
| 6,561,736 | B1 * | 5/2003 | Doleshal | 405/251 |
| 6,718,713 | B2 * | 4/2004 | McKague et al. | 52/309.13 |
| 6,735,919 | B1 | 5/2004 | diGirolamo et al. | |

* cited by examiner

*Primary Examiner* — Mark Wendell
(74) *Attorney, Agent, or Firm* — Coats & Bennett, P.L.L.C.

(57) ABSTRACT

A composite wood-metal structural member comprises a web and a pair of flanges. The web is at least partially made of metal and the flanges are at least partially made of wood. The web includes a pair of metal panels and each panel includes a central section and a pair of end sections. The end sections wrap around a part of the flanges and are attached thereto.

27 Claims, 8 Drawing Sheets

METAL-WOOD STRUCTURAL MEMBER

FIELD OF THE INVENTION

The present invention relates generally to composite structural members and more particularly to a wood-medal composite member which may be used in a variety of structural applications.

BACKGROUND OF THE INVENTION

In light framed building construction there is a need for structural components that are light, strong, and versatile. Metal framing components find significant applicability in this connection as do wooden framing materials. It is common to use metal and wood in combination in some very limited structural element application such as laminated wood and steel girders and headers. Such elements are, however, both heavy and expensive.

There also arises the need for structural elements that are not only effective in carrying loads longitudinally, as in column applications, and transversely, as in beam applications, but are also effective in resisting angular or shear deformation of structural subassemblies such as walls, floors, and roofs.

BRIEF SUMMARY OF THE INVENTION

The present invention is an elongated structural member constructed of wood and metal in a configuration characterized by a web and a pair of flanges. The composite feature is accomplished by constructing the web at least in part of metal and the flanges at least in part of wood. The web includes a pair of panels, each having a central section and two end sections. The central sections of the panels extend in parallel relationship, and the end sections form a pair of receivers disposed at each end of the web. A flange is seated within each receiver, and the components of the structural member are secured together to form the wood-metal structural member. The composite structural member combines and provides the strength of metal with the light weight of wood and the ease of connecting other construction materials to wood.

Other objects and advantages of the present invention will become apparent and obvious from a study of the following description and the accompanying drawings which are merely illustrative of such invention.

DETAILED DESCRIPTION OF THE INVENTION

Figure 1:
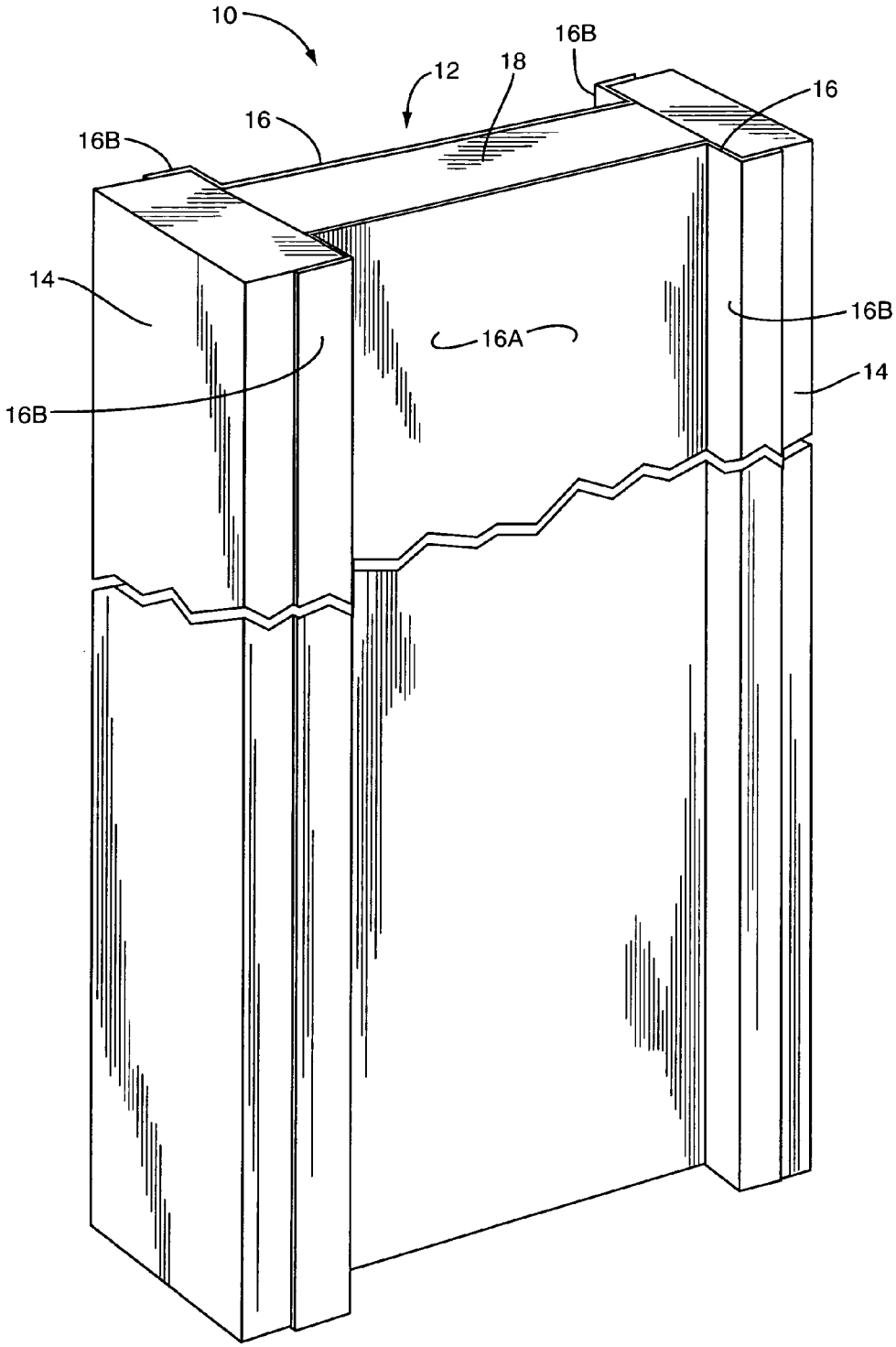
FIG. 1 is a perspective view of one embodiment of the composite structural member of the present invention.

Turning now to the drawings, and particularly to FIG. 1, the metal-wood composite structural member of the present invention is shown therein and indicated generally by the numeral 10. The structural member 10 comprises a web 12 and a pair of flanges 14. Web 12 includes a pair of metal panels 16 each having a generally planar central section 16A and a pair of L-shaped end sections 16B. Central sections 16A of the pair of panels 16 are disposed in a back-to-back arrangement so that each pair of end sections 16B forms a receiver for one of the flanges 14 which are placed respectively therein and thus partially wrap around the end sections 16B of the panels.

Disposed between the central sections 16A of the metal panels 16 is a continuous wooden inner section 18 abutting the opposing central sections 16A of the panels and abutting the flanges 14. Wooden inner section 18 and flanges 14 are affixed together with the pair of panels 16 using adhesive applied to the abutting areas or other fasteners as will be shown in another embodiment below. Flanges 14 and wooden inner sections 18 are generally standard wooden framing members such as 2×4s, 2×6s, 2×8s, etc., and may be selected as needed to provide the required dimensions of the structural member. Likewise, panels 16 are fabricated in various dimensions to accommodate various combinations of flanges 14 and inner sections 18. The resulting composite structural member 10 is thus stronger and more structurally stable than a similarly-sized member made entirely of wood and lighter and less expensive than a similarly-sized member made entirely of metal.

Figure 2:
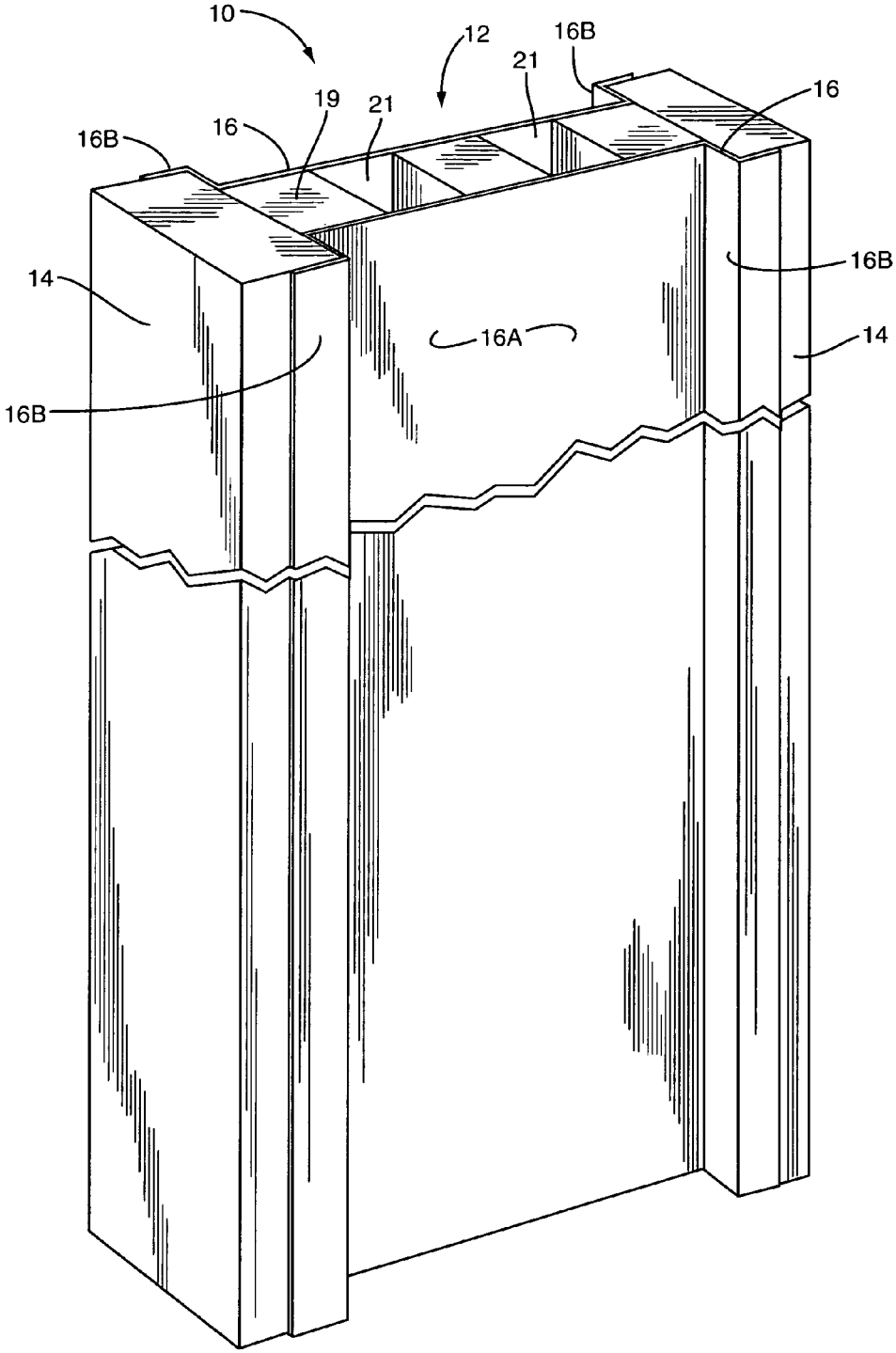
FIG. 2 is a perspective view of a second embodiment of the composite structural member of the present invention.

There are often applications in which the loading conditions are such that a continuous inner wooden section is not necessary. The embodiment shown in FIG. 2 may be used in such cases. In FIG. 2, the composite structural member 10 includes a wooden inner section made up of a series of spaced-apart wooden members 19 disposed between the back-to-back central sections 16A of the metal panels 16. As seen in FIG. 2, the inner wooden members 19 extend generally parallel to the flanges 14. Because of the spaced apart nature of the wooden members 19, there is defined one or more voids 21 that extend through the web 12. This embodiment demonstrates further the advantage of reduced weight to meet a particular need or load requirement.

Figure 3:
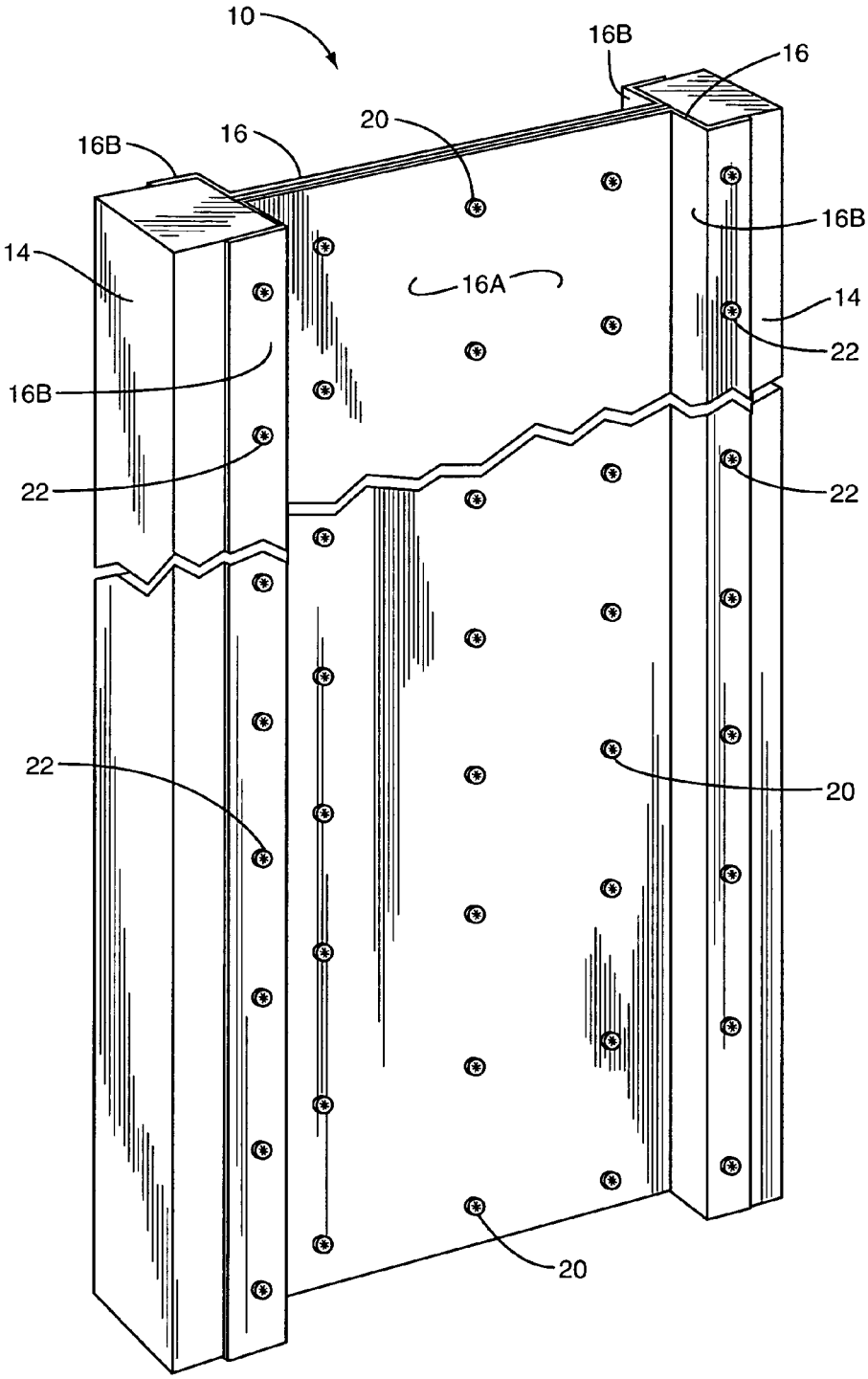
FIG. 3 is a perspective view of a third embodiment of the composite structural member of the present invention.

There are situations in which no wooden inner section is required as shown in FIG. 3. In this embodiment the central sections 16A of the pair of metal panels 16 abut directly. Web 12 is comprised entirely of metal, being made up of the central sections 16A of the pair of metal panels 16. In this particular embodiment metal screw fasteners 20 connect the central sections 16A to each other and wood screw fasteners 22 connect the end sections 16B of the panels 16 to the flanges 14. It is appreciated that wood screw fasteners 22 can be used in the earlier embodiments of FIG. 1 and FIG. 2 to connect the central sections 16A to the continuous wooden inner section 18 or the spaced-apart inner wooden members 19 as well as the end sections 16B to the flanges 14. It is further appreciated that added structural integrity can be realized by the use of metal screw fasteners 20 and wood screw fasteners 22 in combination with adhesive materials placed between the various abutting surfaces.

FIGS. 5-8 illustrate various bracket designs for securing the structural member 10 to an adjacent structure such as a floor structure. Viewing the design of FIG. 5 it is seen that there is provided a pair of metal brackets with each bracket indicated generally by the numeral 50. In the example illustrated in FIG. 5, the metal brackets 50 attach the structural member 10 to an underlying structure such as a floor. It is appreciated that the same metal brackets 50 can be secured to the upper or opposite end of the structural member 10 for connecting to an overhead structure.

Figure 5:
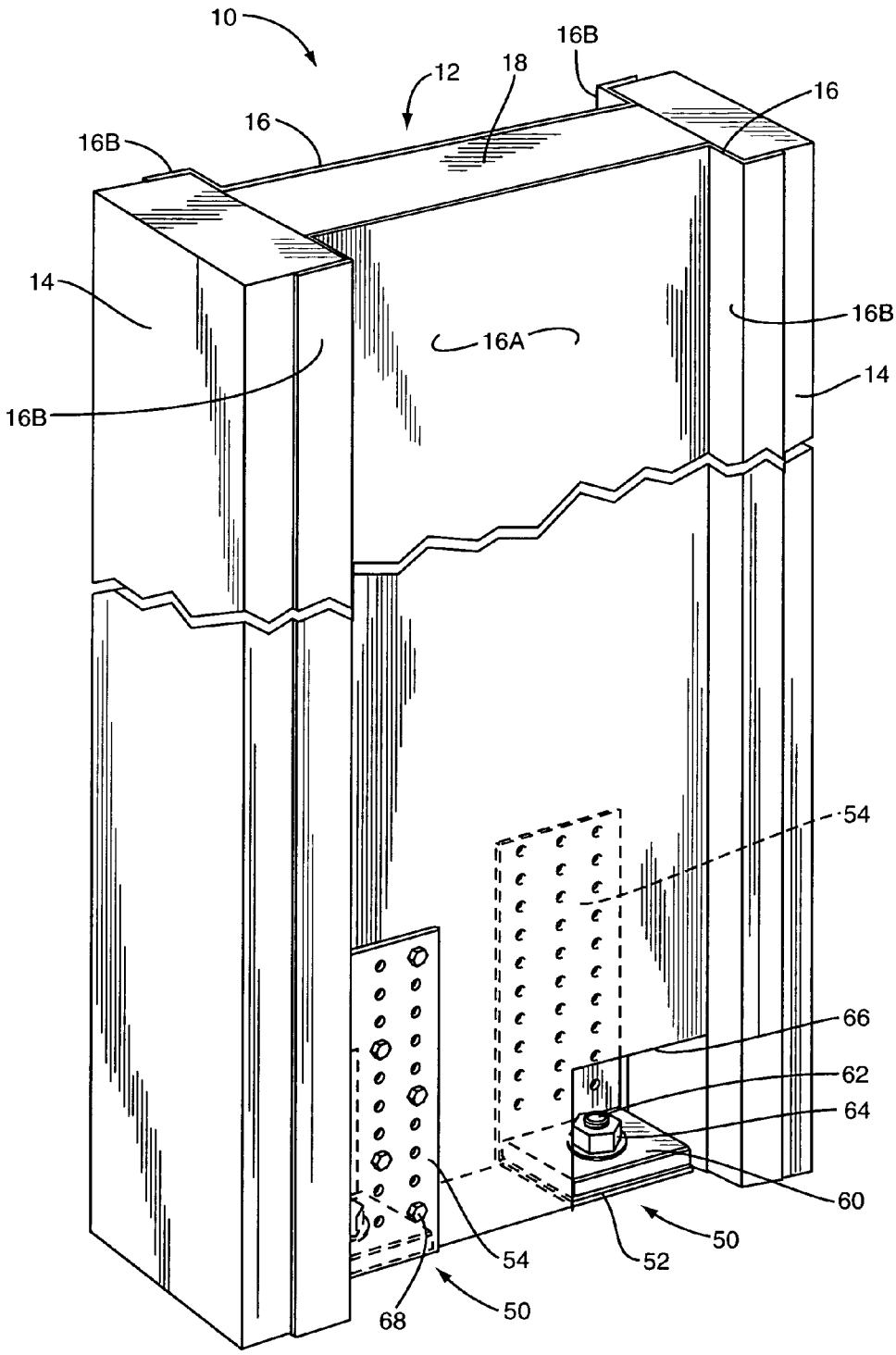
FIG. 5 is a perspective view of the structural member of the present invention illustrating a metal bracket for attaching the structural member to an adjacent structure.

Metal bracket 50 includes a base 52 and an upstanding leg 54. Base 52 is provided with an opening through which a bolt 62 extends. Disposed over the base 52 is an optional reinforcing plate 60. A nut 64 is secured to the bolt 62 and functions to securely connect the metal bracket 50 to the underlying structure. Leg 54 includes a series of openings through which fasteners 68 extend. Fasteners 68 are secured into the web 16 of the structural member 10. In the embodiment of FIG. 5 there is provided a notched-out portion 66. The notched-out portion 66 is formed in the web 16. This enables an installer or operator to gain access to the nut 64 for installing or removing the structural member 10. The notched-out portion 66 would include a portion of the central section 16A of one panel 16 and a portion of the wooden inner section 18.

Figure 6:
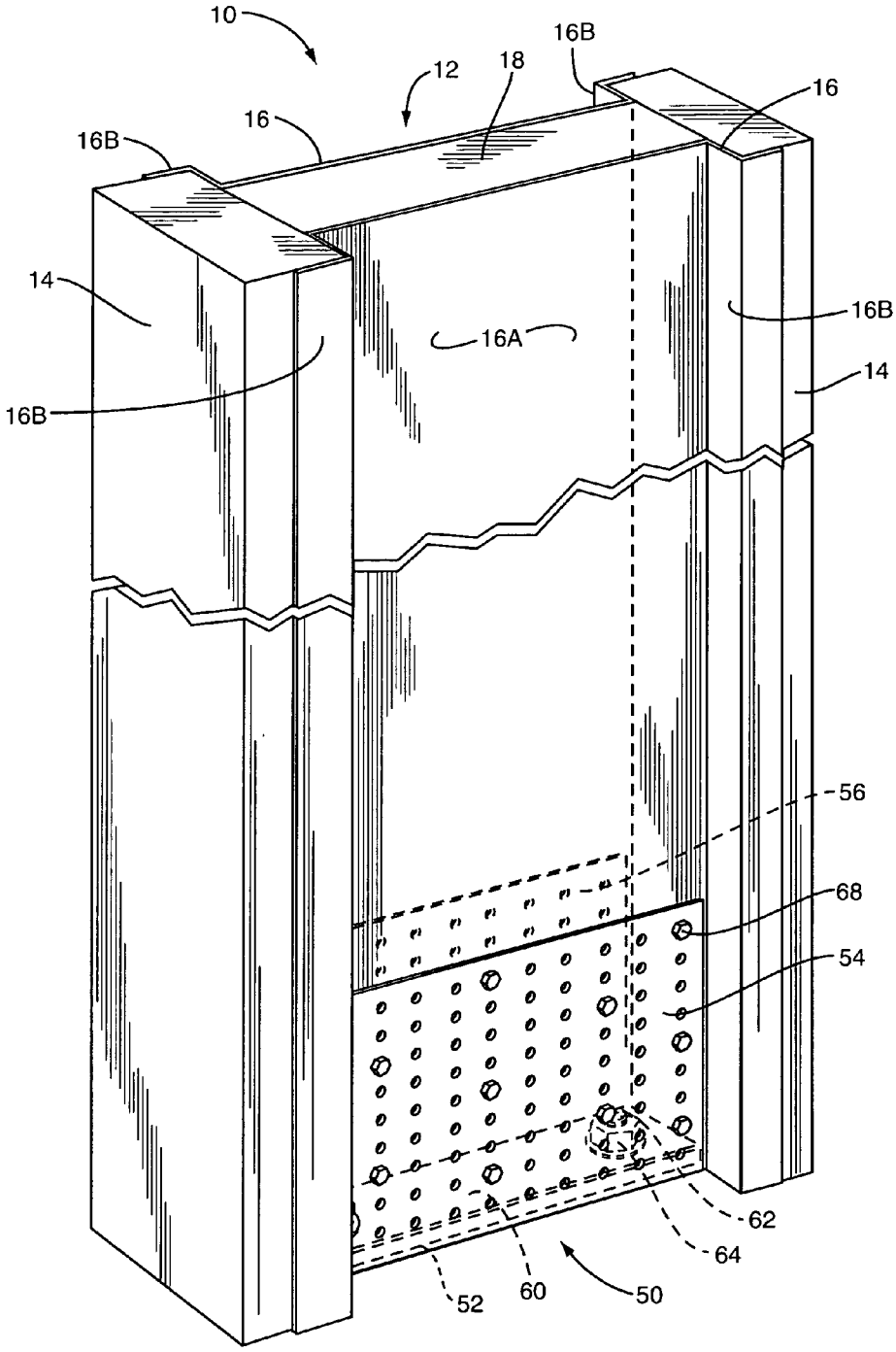
FIG. 6 is a view similar to FIG. 5, but illustrating another embodiment for the metal bracket.

FIG. 6 illustrates another embodiment of the structural member 10 and the metal bracket 50. In this case the metal bracket 50 includes an additional leg 56 such that the metal bracket assumes a generally U-shape. That is, together the base 52 along with the two legs 54 and 56 form a U-shaped metal bracket. Bracket 50 is wrapped around the lower portion of the central sections 16A of the web 16. That is, the legs 54 and 56 are disposed outside of the central section 16A and abut thereagainst. As seen in FIG. 6 the U-shaped bracket 50 extends between the flanges 14 and end sections 16B of the panels 16. To facilitate the installation of the design shown in FIG. 6, the end portion of the structural member 10 that is inserted into the metal bracket 50 can be slightly indented to provide a space for the base 52 and the nut and bolt structures 62 and 64.

Figure 7:
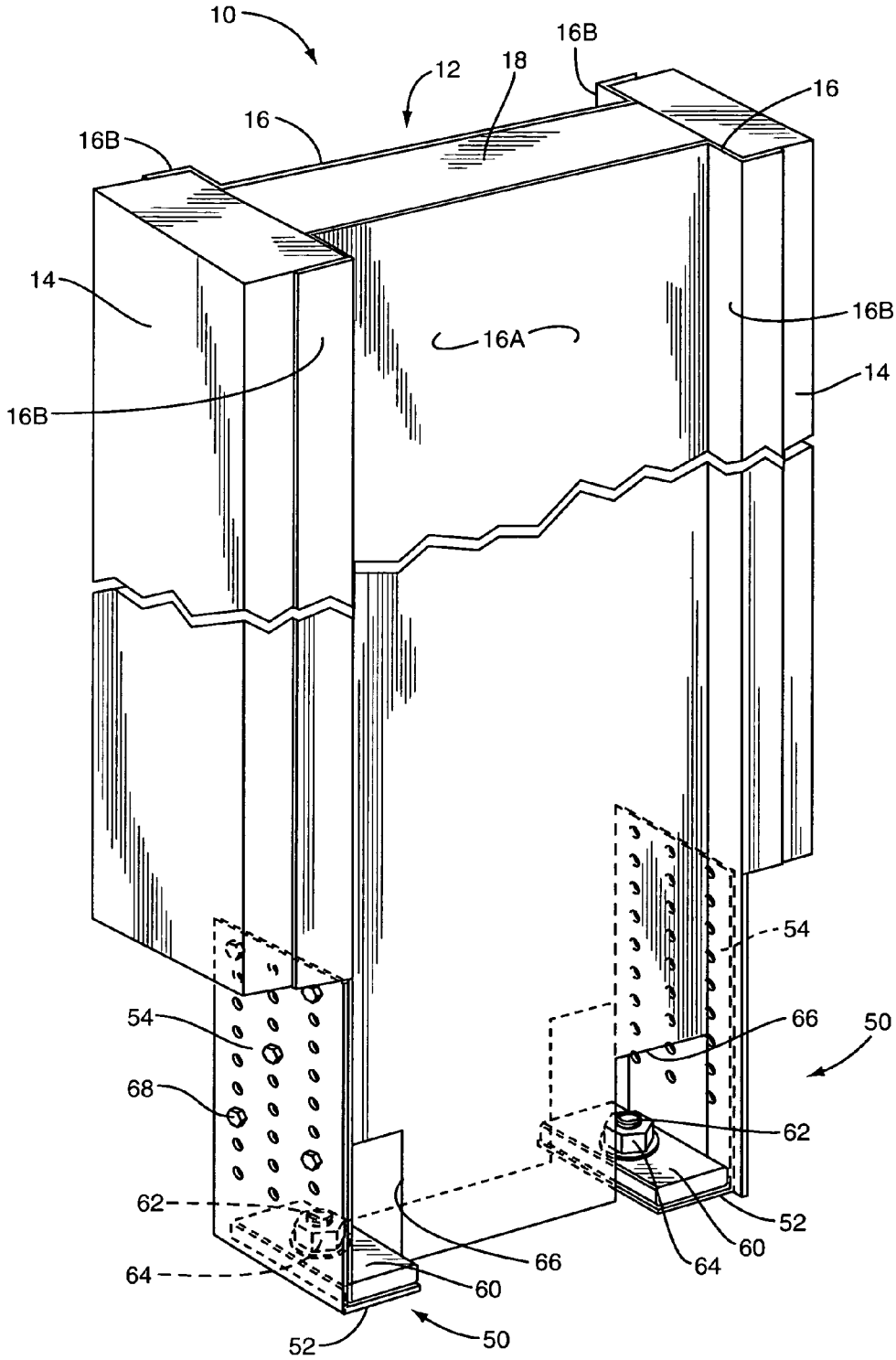
FIG. 7 is a view similar to FIG. 5, but illustrating the metal bracket being attached in a different way to the structural member.

The design of FIG. 7 is similar to the design shown in FIG. 5. One difference is that the metal bracket in FIG. 5 includes a leg 54 which is disposed in a position such that it extends generally parallel with the central sections 16A of the panels 16. In the embodiment shown in FIG. 7, legs 54 are disposed transversely with respect to the central sections 16A of the panels 16. In this case, lower portions of the flanges 14 as well as portions of the end sections 16B have been removed to form lower outside void areas for receiving the leg 54 of the brackets 50. In the case of the FIG. 7 design, the leg 54 is secured to a portion of the end sections 16B of the panels 16. As seen in FIG. 7 a series of bolts or fasteners 68 extend into the end sections 16B of the panels.

Figure 8A:
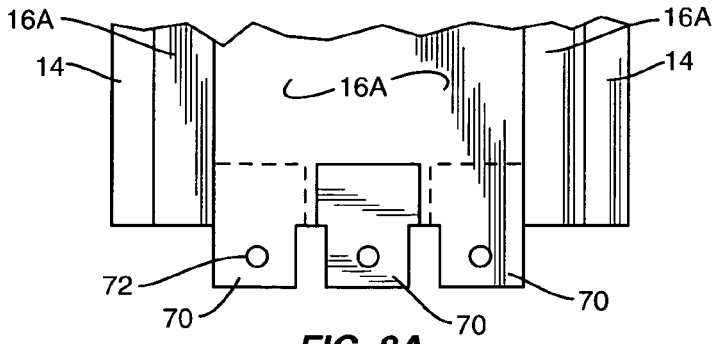
FIGS. 8A-8C are a sequence of views illustrating a series of tabs that form a part of the structural member and which are utilized to secure the structural member to an adjacent structure.
Figure 8B:
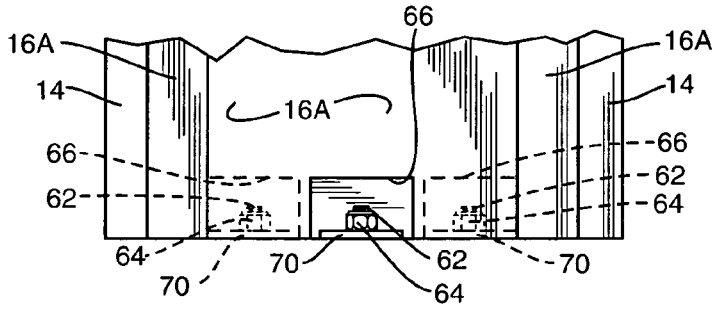
Figure 8C:
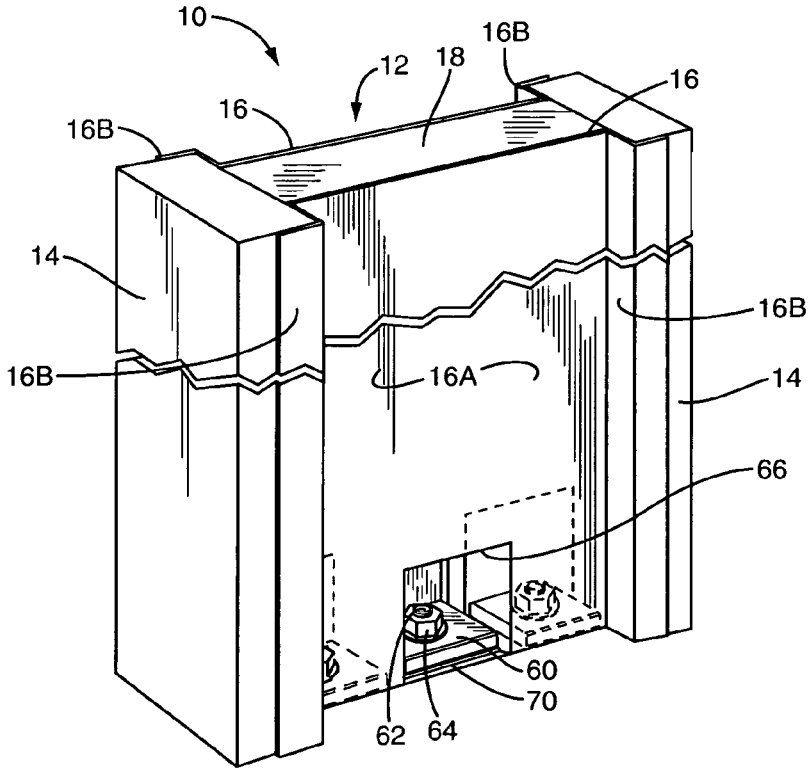

Turning to FIGS. 8A-8C, in this design the structural member 10 is provided with one or more tabs 70 that are turned to form a connector that connects to an adjacent structure. Tabs 70 include an opening 72 formed therein. The tabs 70 that project below the flanges 14 are spaced apart and can be turned as shown in FIG. 8B to fit flush adjacent a floor or adjacent structure. A bolt 62 is projected upwardly from a support structure through the opening 72 in each tab 70 and a nut 64 is screwed down so as to secure the structural member 10 to the adjacent structure. Note in the examples shown in FIGS. 8A-8C there is provided three tabs 70 with the respective tabs being alternating. By being alternating it is meant that each succeeding tab 70 extends from the opposite central section 16A of the panels 16.

Like other embodiments, the web 16 may include notched-out portions 66 to gain access to the nut 64. Further, in the embodiment shown in 8C, the connecting structure is reinforced by a reinforcing plate 60 which is optional. The reinforcing plate 60 is sandwiched between the nut 64 and an underlying washer and the tabs 70. Like the embodiments discussed above, the tabs 70 can project from opposite ends of the structural member 10. In this case, the tabs are integral with the metal panels 16 and project outwardly at opposite ends from the central sections 16A of the panels 16.

Figure 4:
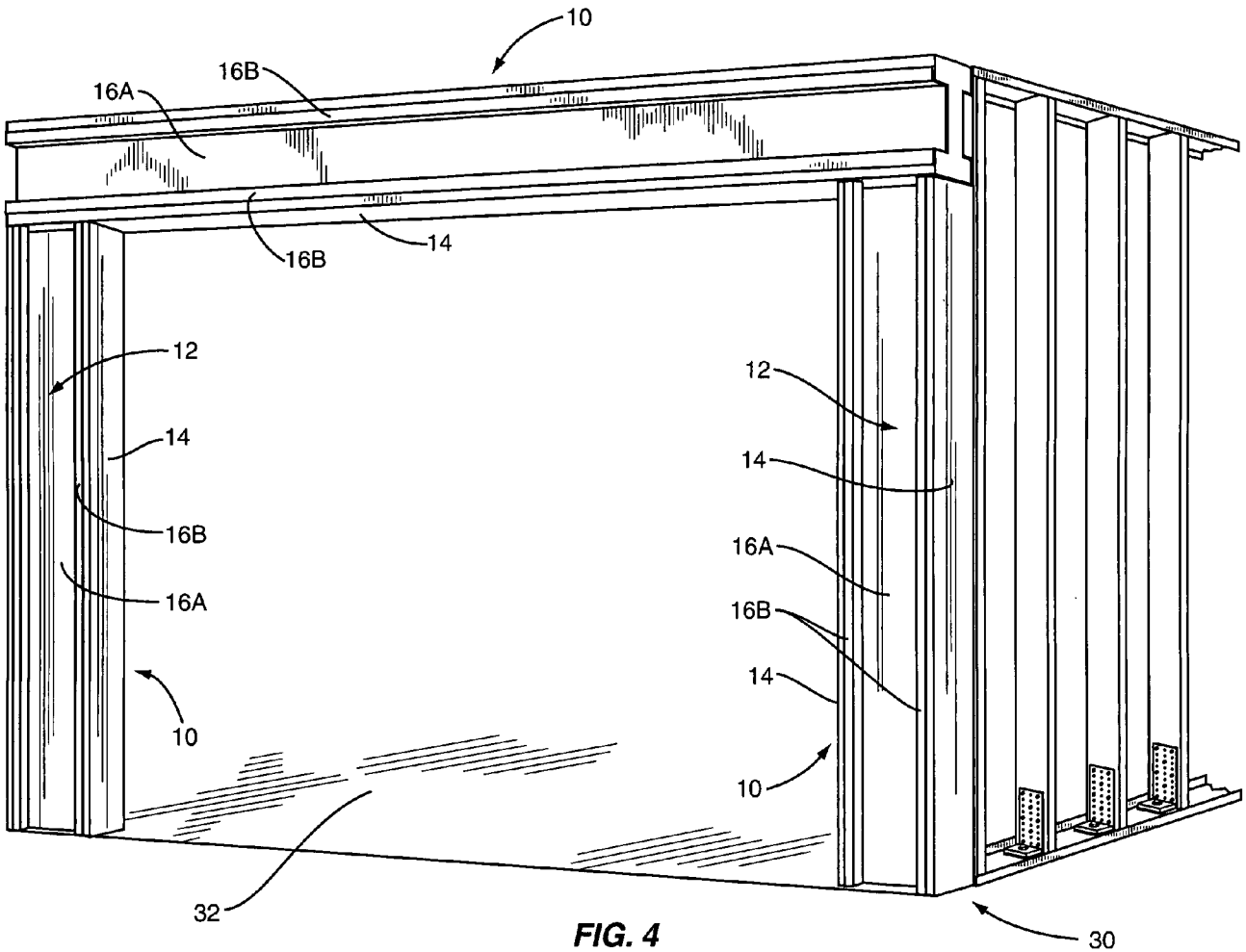
FIG. 4 is a perspective view of a portion of a building structure having the structural member of the present invention incorporated therein.

Turning now to the application and use of the composite structural member 10 of the present invention and considering FIG. 4, it is appreciated that a general structural wall section, generally denoted by the numeral 30, containing a garage door opening 32B may be framed using a plurality of composite structural members 10 of the present invention and, alternatively or additionally, also using the composite structural member 10 as a header. It is appreciated that in the process of construction, two columns, each comprised of the composite structural member 10, can be installed on either side of the opening 32B and the header thereafter placed atop the columns such that a portion of the load from the header is borne axially by each column. When used as a column in this application, the composite structural member 10 is oriented such that the web 12 and flanges 14 extend vertically. It is further appreciated that when used as a header in this particular application, the web 12 extends horizontally over the opening 32B and the flanges 14 are oriented one above the other. Positioned thusly as a header, the composite structural member 10 acts to carry the loads above the garage door opening 32B and transmit them to the supporting columns. It is further appreciated that because of the wood-metal nature of the composite structural member 10, various wall surfaces and other wall attachments can easily be attached to the wood portions of the composite structural member 10.

While not described in detail here, it is appreciated that the metal-wood composite structural member 10 of the present invention can be effectively used in any situation where beam or columnar load resistance is needed. Such situations include but are not limited to girders, joists, and rafters. Moreover, use of a composite structural member of the current invention in the place of one or more studs in a wall section can affect improved resistance to shear and buckling of the wall.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. An elongated composite structural member comprising:

a. a first and a second main flange made at least in part of wood, b. a main web made at least in part of metal, c. wherein the main web includes first and second metal panels secured to the first and second main flanges;

d. the first and second panels each including a central section and a pair of end sections;

e. the end sections at least partially wrapping around the main flanges and wherein the end sections are secured to the main flanges;

f. the main web including a wooden inner section;

g. the first and second panels each including a central section and wherein the central sections of the first and second panels are disposed adjacent the wooden inner section and secured thereto;

h. wherein the wooden inner section is sandwiched between the first and second panels;

i. wherein the first and second panels each include a central section and a pair of end flanges, and j. wherein the end flanges are at least partially wrapped around the main flanges and wherein the end flanges are secure to the main flanges.

2. The composite structural member of claim 1 wherein each end section assumes a generally L shape.

3. The composite structural member of claim 1 wherein the wooden inner section extends continuously from the first main flange to the second main flange.

4. The structural member of claim 1 including at least one metal attaching bracket for connecting the structural member to an adjacent structure, the attaching bracket including a base and a leg extending therefrom wherein the leg is adapted to attach to one metal panel of the web.

5. The structural member of claim 4 wherein the metal bracket assumes a generally L-shape.

6. The structural member of claim 4 wherein the metal bracket assumes a generally U-shape.

7. An elongated wood-metal composite structural member comprising:

a. a web constructed at least in part of metal and including a pair of metal panels with each panel having a central section and a pair of end sections;

b. the end sections being configured to form a pair of opposed receivers on opposite ends of the central section of the web;

c. a flange constructed at least in part of wood and held by each receiver;

d. wherein the end sections of the web are secured to the flanges such that the web and the flanges form the wood-metal composite structural member;

e. at least one metal attaching bracket secured to the wood-metal composite structural member for attaching the member to an adjacent structure;

f. the bracket including a base and a leg extending therefrom where the leg is attached to at least a metal portion of the member; and g. the base and leg having a juncture defined there between and wherein the juncture extends perpendicular to a longitudinal axis of the member.

8. The structural member of claim 7 wherein the metal bracket includes a generally U-shape.

9. The structural member of claim 8 wherein the metal bracket includes the base and two opposed legs and wherein the bracket wraps around opposite sides of an end portion of the web with the opposed legs being disposed outwardly and adjacent to portions of the central sections of the metal panels; wherein the legs are secured to the metal panels of the web.

10. The structural member of claim 7 including a reinforcing plate overlying the base of the metal bracket.

11. The structural member of claim 7 wherein at least one portion of the web is notched out to form an access opening to portions of the metal bracket.

12. The structural member of claim 7 wherein the leg of the metal bracket extends in general parallel relationship with the central sections of the metal panels.

13. The structural member of claim 7 wherein the leg of the metal bracket extends generally transverse with respect to the central sections of the metal panels.

14. The structural member of claim 7 wherein the metal panels include one or more tabs that are turned at an angle with respect to web and wherein the tabs are adapted to attach to the adjacent structure.

15. The structural member of claim 14 wherein there are at least two tabs that are spaced apart and which are turned at an angle to the metal panels of the web, and wherein the tabs project from the central sections of the metal panels and include openings for receiving a fastener.

16. The wood-metal composite structural member of claim 7 wherein the web and flanges form an I-beam.

17. The wood-metal composite structural member of claim 7 wherein the end sections of each panel assume a generally L shape and projects outwardly from the central section.

18. The wood-metal composite structural member of claim 7 wherein the central sections of the panels extend in parallel relationship.

19. The wood-metal composite structural member of claim 7 including at least one wooden member disposed between the panels that form the web.

20. The wood-metal composite structural member of claim 19 wherein the wooden member extends continuously between and abuts the flanges.

21. The wood-metal composite structural member of claim 7 wherein the web includes at least one wooden member sandwiched between the central sections of the panels; and wherein each end section of the panels assumes a generally L-shape and wraps around a respective flange such that opposite pairs of the end sections form one receiver.

22. The wood-metal composite structural member of claim 7 wherein each flange comprises an elongated wooden member seated within a respective receiver.

23. A building wall section including at least one structural column comprising the elongated structural member of claim 1.

24. A building wall section including at least one opening and a structural header extending over the opening and comprising the elongated structural member of claim 1.

25. An elongated wood-metal composite structural member comprising:

a. a web constructed at least in part of metal and including a pair of metal panels with each panel having a central section and a pair of end sections;

b. the end sections being configured to form a pair of opposed receivers on opposite ends of the central section of the web;

c. a flange constructed at least in part of wood and held by each receiver;

d. wherein the end sections of the web are secured to the flanges such that the web and the flanges form the wood-metal composite structural member; and e. at least one portion of the web having a notch formed therein to form an access opening to an internal area between the metal plates of the web and to a metal bracket.

26. The structural member of claim 25 wherein the central sections of the web are spaced apart and wherein each central section includes an end and wherein the notch is formed in the end of at least one central section.

27. The structural member of claim 26 wherein the attaching bracket is secured to one of the central sections opposite the central section having the notch form therein such that access can be gained to at least a portion of the attaching bracket through the notch.

* * * * *